US006263915B1

(12) United States Patent
Hayashi et al.

(10) Patent No.: US 6,263,915 B1
(45) Date of Patent: Jul. 24, 2001

(54) DIRECTIONAL CONTROL VALVE HAVING POSITION DETECTING FUNCTION

(75) Inventors: Bunya Hayashi; Makoto Ishikawa, both of Ibaraki (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 09/590,369

(22) Filed: Jun. 9, 2000

(30) Foreign Application Priority Data

Jul. 14, 1999 (JP) ..... 11-200500

(51) Int. Cl.[7] ..... F15B 13/044

(52) U.S. Cl. ..... 137/554; 137/625.65; 137/884; 137/625.64

(58) Field of Search ..... 137/625.64, 554, 137/625.65, 884

(56) References Cited

U.S. PATENT DOCUMENTS 4,953,590 * 9/1990 Kakinuma et al. ..... 137/554
5,101,856 * 4/1992 Kakinuma et al. ..... 137/554
5,623,967 4/1997 Hayashi ..... 137/625.64
5,785,087 * 7/1998 Takahashi et al. ..... 137/625.65
5,826,616 * 10/1998 Golden ..... 137/554

FOREIGN PATENT DOCUMENTS 2-66784 5/1990 (JP) .
2-66785 5/1990 (JP) .
2-88079 7/1990 (JP) .

* cited by examiner

*Primary Examiner*—A. Michael Chambers
(74) *Attorney, Agent, or Firm*—Oblon, Spivak, McClelland, Maier & Neustadt, P.C.

(57) ABSTRACT

A directional control valve having a position detecting function, is capable of detecting the operating positions of the valve member over the whole stroke thereof, without using a magnet and a magnetic sensor. A position detection mechanism 20 for detecting operating positions of a spool includes a detection coil disposed on a casing and generating an alternating magnetic field; a detection head mounted on a piston and changing the impedance of the detection coil by approaching or moving away from the detection coil in the alternating magnetic field; and a signal processing circuit applying an alternating voltage to the detection coil and detecting operating positions of the spool from the change in impedance of the detection coil.

3 Claims, 2 Drawing Sheets

DIRECTIONAL CONTROL VALVE HAVING POSITION DETECTING FUNCTION

CROSS-REFERENCE TO RELATED APPLICATIONS

This application is related to and claims priority under 35 U.S.C. §119 to Japanese Patent Application No. 11-200500 filed on Jul. 14, 1999, the entire contents of which is incorporated by reference herein.

BACKGROUND OF THE INVENTION

1. Field of the Invention

The present invention relates to a directional control valve having a position detecting function, capable of detecting operating positions of a valve member such as a spool.

2. Discussion of Background

The directional control valve capable of detecting the operating position of a spool is well known as disclosed in, for example, Japanese Unexamined Utility Model Publication No. 2-66784. This known directional control valve is provided with a magnet on the outer periphery of a spool and provided with a magnet sensor on a casing. This directional control valve is arranged so that, when the spool moves to one changeover position, the magnet approaches the magnetic sensor, and the magnetic sensor is turned on, and that, when the spool moves to the other changeover position, the magnet moves away from the magnetic sensor, and the magnetic sensor is turned off. Thus, this directional control valve detects that the spool has been changed over by the on/off of the magnetic sensor.

However, since the above-described conventional directional control valve installs the magnet at a position situated in the fluid passage on the outer periphery of the spool, the magnet directly contacts the hydraulic fluid. Therefore, when the fluid contains water, chemical mist, particulates of magnetic material such as metallic powder, or the like, there has often arisen the problem that the contact of the magnet with these substances makes the magnet rust, corrode, or adsorb the particulates, thereby bringing about drawbacks of reducing the detection accuracy due to the decrease in magnetic force, or incurring poor sliding conditions.

Furthermore, although the above-described known directional control valve can detect the position of the spool situated at a stroke end by detecting the magnet, this directional control valve can not detect any position of the spool on the way of a stroke. Therefore, even if the spool makes an irregular movement deficient in smoothness due to some abnormality, it can not detect this abnormality. This has made it difficult to take suitable precautions against a failure or an accident before they happen, and has thus raised a problem in the maintenance and management.

In addition, a magnetic sensor for detecting a magnet is generally constituted so as to be turned on when the magnetic flux density is above a fixed value, and to be turned off when it is below another fixed value. Therefore, during the driving stroke of the spool, if the magnetic flux density becomes higher than the fixed value due to the approach of a magnet, the magnetic sensor is turned on even before the spool arrives at a stroke end, and conversely, during the return stroke of the spool, if the magnetic flux density becomes lower than the other fixed value due to the moving-away of the magnet, the magnetic sensor is turned off even before the spool arrives at the return-stroke end. Therefore, even if the magnetic sensor stops on the spot for some reason at the instant when the magnetic sensor are turned on or turned off, the magnetic sensor only outputs an on/off signal notifying that the spool has been completely changed over. It is thus impossible for conventional magnetic sensors to detect an abnormality.

SUMMARY OF THE INVENTION

The technical problem of the present invention is to provide a directional control valve having a position detecting function, capable of detecting the operating positions of the valve member over the whole stroke thereof, without using a magnet and a magnetic sensor as in the conventional art.

In order to solve the above-described problems, the directional control valve of the present invention comprises a plurality of ports; a valve hole to which each of these ports is opened; a casing having the ports and the valve hole; a valve member slidably received in the valve hole and changing over flow passages; driving means for driving said valve member; a detection coil disposed on the casing and generating an alternating magnetic field; a detection head which is disposed so as to be displaced in synchronization with the valve member and which changes the impedance of the detection coil by approaching or moving away from the detection coil in the alternating magnetic field; and a signal processing circuit applying an alternating voltage to the detection coil and detecting operating positions of the valve member from the change in impedance of the detection coil.

In the directional control valve of the present invention having the above-described features, when the detection head moving in synchronization with the valve member approaches or moves away from the detection coil, the impedance of the detection coil changes in response to the distance from the detection head, so that the operating position can be detected from this change in impedance. It is therefore possible to discriminate whether the valve member has normally operated or not, from the relations between the operating position and the operating time, and thus to take suitable precautions against a failure or an accident before they happen.

Since there is no need to dispose a magnet in the flow passage of a hydraulic fluid on the outer periphery as in the conventional art, even if the hydraulic fluid is at a high temperature or contains water, chemical mist, magnetic particles such as metallic powders, or the like, it is unnecessary to take countermeasures against rusting or corroding, the adsorption of magnetic particles, the reduction in magnetic force, the change in temperature, etc. This permits the achievement of a simple, long-life, and high-reliability directional control valve.

In accordance with a specific embodiment of the present invention, there are provided a piston which changes over the valve member by operating under the action of a pilot fluid pressure and which is disposed on at least one end side of the valve member, the detection head disposed on one piston, and the detection coil disposed on the casing portion.

In accordance with another preferable embodiment of the present invention, the above-described detection coil is a high-frequency coil for generating a high-frequency magnetic field, and the above-described detection head is formed of metal. Alternatively, the above-described detection coil is a low-frequency coil for generating a low-frequency magnetic field, and the above-described detection head is formed of magnetic body and is adapted to be taken in and out of the hollow portion of the coil by the movement of the piston.

BRIEF DESCRIPTION OF DRAWING FIGURES

DETAILED DESCRIPTION OF THE PREFERRED EMBODIMENTS

Figure 1:
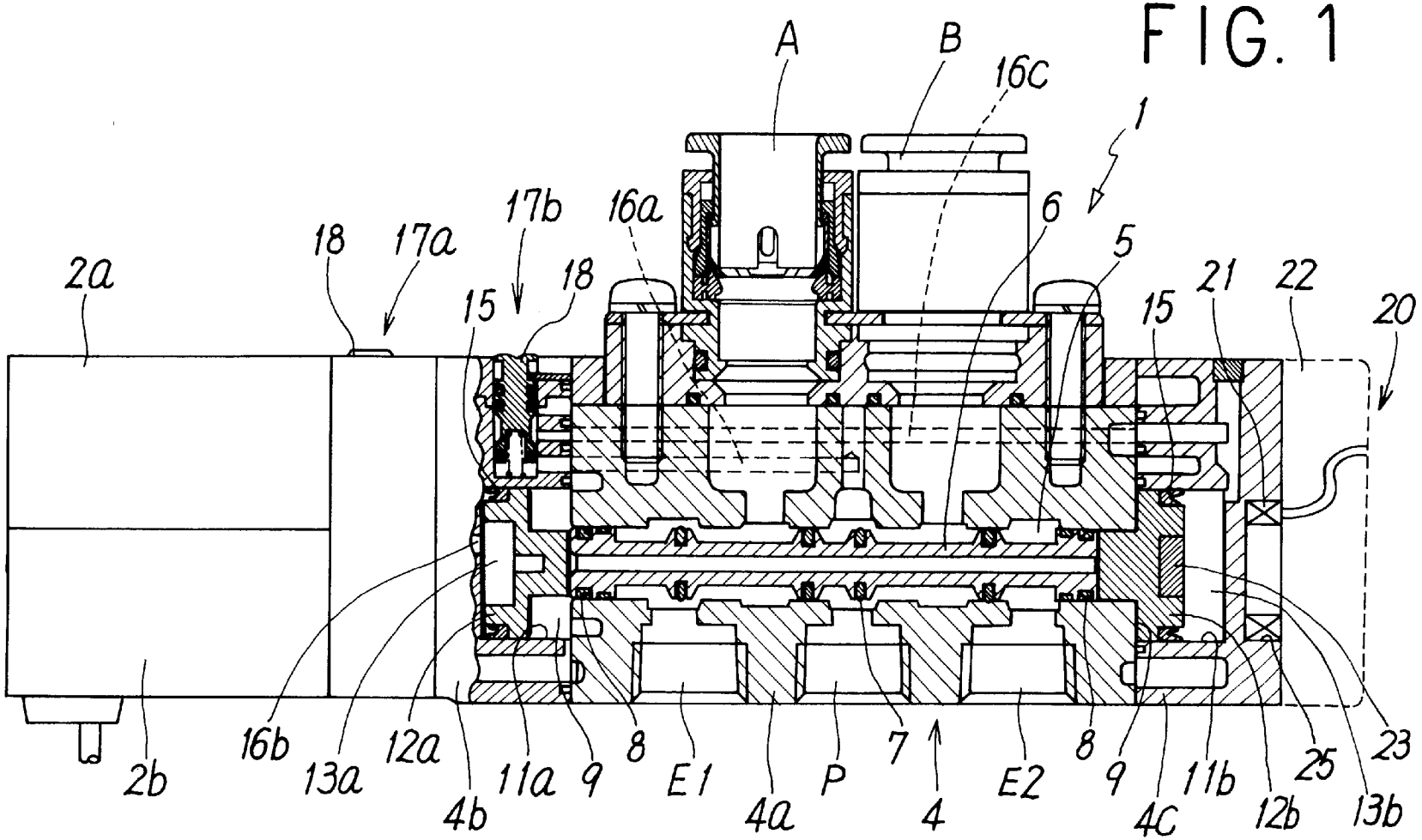
FIG. 1 is a longitudinal sectional view of a first embodiment of the directional control valve in accordance with the present invention.
Figure 2:
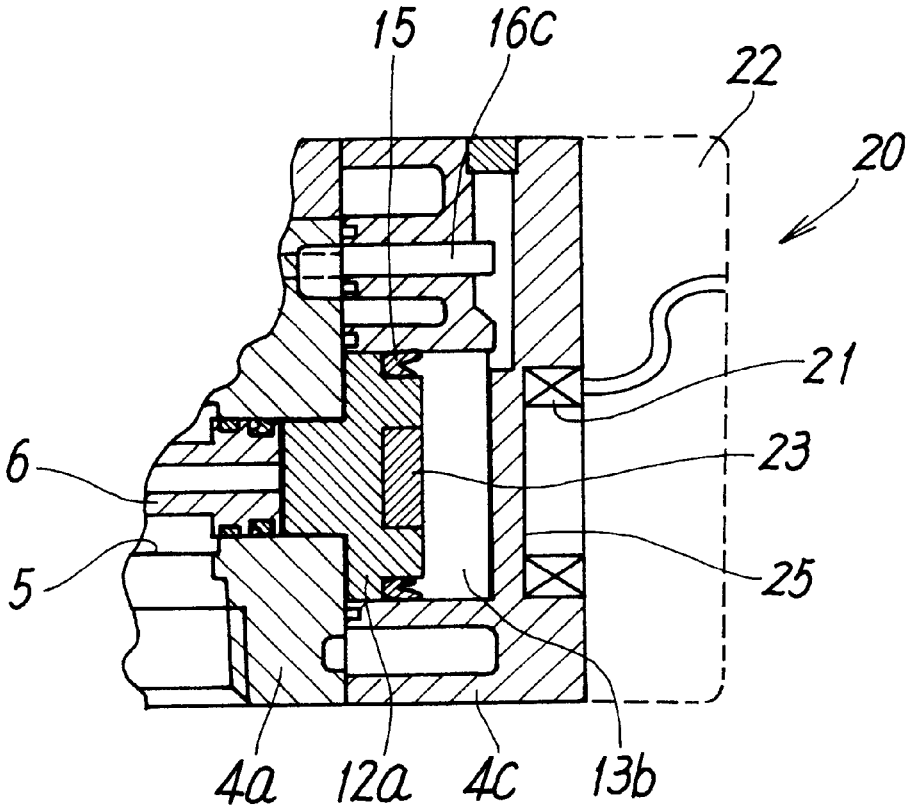
FIG. 2 is an enlarged view showing the main section of FIG. 1.

FIGS. 1 and 2 show the first embodiment of the directional control valve in accordance with the present invention. The directional control valve here exemplified is a double-pilot type directional control valve wherein a main valve 1 is changed over by two pilot valves 2*a* and 2*b*.

The main valve 1 has a construction as a 5-port valve, and includes a casing 4. The casing 4 comprises a first member 4*a* of cuboid shape, a second member 4*b* which is connected to the one end of the first member 4*a* and which also serves as an adapter for concentratedly mounting the two pilot valves 2*a* and 2*b*, and a third member 4*c* which is connected to the other end of the first member 4*a* and which functions as an end cover. Here, at lease the third member is formed of non-magnetic material.

A supply port P and two discharge ports E1 and E2 are provided on either of the upper and lower surfaces of the first member 4*a*, and two output ports A and B are provided on the other surface. Inside the first member 4*a*, there is provided a valve hole 5 to which these ports are each opened being arranged in the axial direction. In the valve hole 5, there is slidably received a spool 6 which is a valve member for changing over flow passages.

On the outer periphery of the spool 6, there are provided a plurality of sealing members 7 for mutually defining flow passages connecting the above-mentioned ports, and on the outer peripheries of both ends of the spool 6, there are provided end sealing members 8 for shutting off the breathing chambers 9 facing the ends of the spool 6, from some flow passages.

On the other hand, in the second member 4*b* and the third member 4*c*, the piston chamber 11*a* and 11*b* are formed, respectively, at the positions facing both ends of the spool 6, and pistons 12*a* and 12*b* are slidably received in the respective piston chambers 11*a* and 11*b*, each abutting against respective end faces of the spool 6.

On the back sides of the pistons 12*a* and 12*b*, that is, at portions adjacent to the pressure receiving surfaces opposite to the end faces of the pistons abutting against the spool 6, pilot pressure chambers 13*a* and 13*b* are formed, respectively. Between the pistons 12*a* and 12*b*, and the end faces of the spool 16, there are formed breathing chambers 9 and 9 which are opened to the outside, respectively. The pressure chambers 13*a* and 13*b* are hermetically shut off from the breathing chambers 9 and 9 by piston packing 15 and 15 mounted on the outer peripheries of the piston 12*a* and 12*b*, respectively.

The first pressure chamber 13*a* situated adjacent to the first piston 12*a* communicates with the supply port P through the pilot fluid passages 16*a* and 16*b* via a first pilot valve 2*a* and a first manual operating mechanism 17*a*, while the second pressure chamber 13*b* situated adjacent to the second piston 12*b* communicates with the supply port P through the pilot fluid passages 16*a* and 16*c* via a second pilot valve 2*b* and a second manual operating mechanism 17*b*.

When the first pilot valve 2*a* is in the "off" state, and at the same time when the second pilot valve 2*b* is in the "on" state, the pilot fluid in the first pressure chamber 13*a* is discharged and it is supplied to the second pressure chamber 13*b*, so that the spool 6 is pushed by the second piston 12*b*, and occupies a first changeover position shifted to the left side, as shown in FIG. 1. Once the first pilot valve 2*a* is turned "on", and at the same time the second pilot valve 2*b* is turned "off", the pilot fluid in the second pressure chamber 13*b* is discharged and it is supplied to the first pressure chamber 13, so that the spool 6 is pushed by the first piston 12*a*, and occupies a second changeover position shifted to the right side.

The above-mentioned manual operating mechanisms 17*a* and 17*b* are adapted to directly connect the pilot fluid passages 16*a* with 16*b*, or 16*a* with 16*c* by depressing an operating element 18, and to thereby make the pressure chambers 13*a* and 13*b* communicate with the supply port P. This operating state is the same as that in which the pilot valves 2*a* and 2*b* are both "on".

The above-described pilot valves 2*a* and 2*b* are an electromagnetically operated solenoid valve for opening/closing a pilot fluid passage by energizing a solenoid. Since its constitution and operation are the same as the known one, specific explanation thereof is omitted.

The above-described directional control valve has the above-mentioned position detecting mechanism 20 for detecting operating positions of the spool 6, disposed at the end portion opposite to the side where the two pilot valves 2*a* and 2*b* of the casing 4 is mounted. The position detecting mechanism 20 comprises a detection coil 21 for generating an alternating magnetic field and a signal processing circuit 22, disposed on the third member 4*c* of the casing 4, and the detection head 23 formed on the piston 12*b*.

The detection coil 21 is disposed so as to be coaxial with the second piston 12*b* in a housing 25 formed on the outer surface of the third member 4*c*, and generates a high frequency magnetic field toward the piston chamber 11*b*.

On the other hand, the detection head 23 is formed of metallic member installed at the central portion of the pressure receiving surface of the second piston 12*b*, and is adapted to change the impedance of the detection coil 21 by approaching or moving away from the detection coil 21 in the alternating magnetic field. If the second piston 12*b* is formed of metal, the second piston 12*b* serves as a detection head in itself, and consequently there is no need to install such a metallic member separately.

The above-described signal processing circuit 22 applies an alternating voltage to the detection coil 21, detects operating positions of the piston 12*b* (spool 6) from the change in impedance of the detection coil 21, and outputs the detection signal toward a controller (not shown). As circuits required to achieve these, the signal processing circuit 22 incorporates a oscillating circuit, detecting circuit, an outputting circuit, or the like. Although the signal processing circuit 22 may be disposed at a position other than the position where the directional control valve is disposed, it is preferable to be disposed together with the detection coil 21 at a suitable position on the casing 4 of the directional control valve, as shown in drawings.

In the above-described position detection mechanism 20, when the detection head 23 approaches the detection coil 21 by the movement of the second piston 12*b* from the position shown in FIG. 1 to the second changeover position on the right side, the impedance of the detection coil 21 gradually increases in response to the distance from the detection head 23, and conversely, when the detection head 23 moves away from the detection coil 21 by the return of the second piston 12*b* to the first changeover position, the impedance of the detection coil 21 gradually decreases. From the change in impedance of the detection coil, therefore, operating positions of the second piston 12*b*, and consequently those of the spool 6 can be detect over the whole stroke. Herein, by previously inputting to the signal processing circuit 22 data such as relations between the normal operating position of the spool 6 and the operating time, or the maximum permissible limit of the operating time necessary to move to a specified position, and comparing the detected results with these data, it is possible to discriminate whether the operation of the spool has been normal or abnormal. This permits taking countermeasures against a failure or an accident before they happen.

Also, by disposing the detection coil 21 and the signal processing circuit 22 on the third member 4*c* of the casing 4, the repair or exchange thereof at failure becomes easier, and in some cases they may be exchanged as a whole, whereby the ease of maintenance is improved.

Here, the operating positions, the operating times, etc. of the spool 6 which have been detected can be displayed on a display device in the form of numeral values or graphs.

Figure 3:
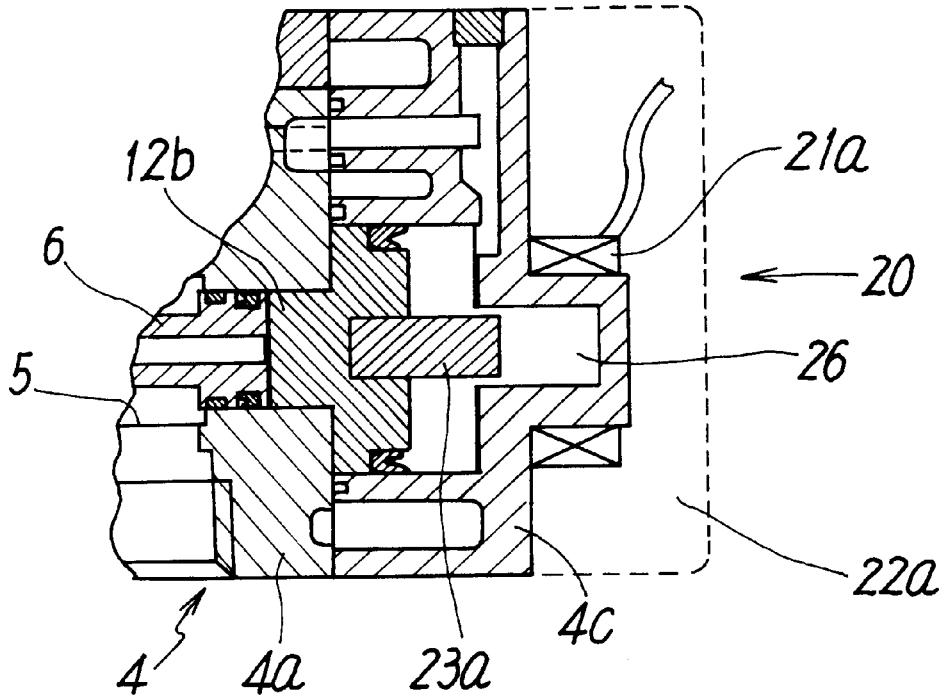
FIG. 3 is a longitudinal sectional view showing the main section of a second embodiment of the present invention.

FIG. 3 shows the main section of the second embodiment of the directional control valve in accordance with the present invention. In this directional control valve, the position detection mechanism 20 comprises a detection coil 21*a* for generating a low-frequency magnetic field, a detection head 23 which changes the impedance of the detection coil 21*a* and which is formed of magnetic material, and a signal processing circuit 22 which applies an low-frequency alternating voltage to the detection coil 21*a* and which detects operating positions of the spool 6 from the change in impedance of the detection coil 21*a*.

The above-described detection coil 21*a* is disposed on the forth member 4*c* of the casing 4, formed of non-magnetic material, so that a hollow portion 26 communicating with the piston chamber 11*b* is formed in the detection coil 21*a*. On the other hand, the detection head 23 is formed of bar-like material having a smaller diameter than the piston 12*b*, and is installed so as to protrude in the axial direction through the center portion of the pressure receiving surface of the piston 12*b*. The detection head 23 is constituted so as to increase and decrease the impedance of the detection coil 21*a* when it is taken in and taken out of the above-mentioned hollow portion 26 in accordance with the displacement of the piston 12*b*.

Since constitutions, operations, effects, and preferable modifications of the second embodiment other than the foregoing are substantially the same as those of the first embodiment, description thereof is omitted.

In each of the above-described embodiments, explanation was made of the case in which the present invention is applied to double-pilot type directional control valve. However, the type of the directional control valve in the present invention is not limited to the double-pilot type, but a single-pilot type directional control valve having one pilot valve may be used.

Furthermore, in each of the above-described embodiments, as the valve member, a spool was shown, but the valve member is not limited to such a spool. For example, the valve member in the present invention may be of the poppet type.

Alternatively, the type of the directional control valve is a direct-acting type directional control valve in which the valve member is directly driven by electromagnetic or mechanical driving means may be employed. In this case, a separately formed detection head is mounted at the end portion of the valve, or a detection head is directly formed at the end portion of the valve.

As described hereinbefore in detail, in accordance with the present invention, without using a magnet and a magnetic sensor as in the conventional art, it is possible to detect the operating positions over the whole stroke of the valve member, by utilizing the property that the impedance of a detection coil changes when a detection head approaches or moves away from the detection coil generating a alternating magnetic field. This makes it possible to discriminate whether the valve member has normally operated or not, from the relations between the operating position and the operating time, and thereby to take suitable countermeasures against a failure or an accident before they happen.

What is claimed as new and desired to be secured by Letters Patent of the United States is:

1. A directional control valve having a position detecting function, comprising:

a plurality of ports:

a valve hole to which each of said ports is opened;

a casing having said ports and said valve hole;

a valve member for changing over flow passages, said valve member being slidably received in said valve hole;

driving means for driving said valve member;

a detection coil for generating an alternating magnetic field, said detection coil being disposed at a portion formed by non-magnetic material, in said casing;

a detection head for changing an impedance of said detection coil by approaching or moving away from said detection coil, said detection head being disposed in said casing so as to be displaced in synchronization with said valve member;

a signal processing circuit for applying an alternating voltage to said detection coil and detecting an operating position of said valve member from a change in the impedance of said detection coil; and said directional control valve being a double-pilot type directional control valve having two pistons and two pilot valves, wherein said two pilot valves are concentratedly installed in said casing at an end portion of a first piston of said two pistons, wherein said detection coil is installed at a position adjacent to a second piston of said casing, and wherein said detection head is disposed on a second piston of said two pistons.

2. The directional control valve as claimed in claim 1, wherein said detection coil is a high-frequency coil for generating a high-frequency alternating magnetic field, said detection coil being disposed in a recess formed in an end face of said casing, and wherein said detection head is a metallic member.

3. The directional control valve as claimed in claim 1, wherein said detection coil is a low-frequency alternating magnetic field, said detection coil being disposed at an end portion of said casing, and wherein said detection head is formed of magnetic material into a bar, said detection head being constructed so as to be taken in and taken out of a hollow portion of said detection coil.

* * * * *